US005698782A

United States Patent [19]

Gledhill

[11] Patent Number: 5,698,782

[45] Date of Patent: Dec. 16, 1997

[54] HAND AND ARM STRENGTH TESTING APPARATUS TO BE USED IN A CONSTABLE SELECTION PROCESS

[75] Inventor: Norm Gledhill, Toronto, Canada

[73] Assignee: Ministry Of Solicitor General And Correctional Services, Toronto, Canada

[21] Appl. No.: 781,064

[22] Filed: Jan. 9, 1997

[51] Int. Cl.[6] ..... A63B 23/00

[52] U.S. Cl. ..... 73/379.03

[58] Field of Search ..... 73/865.6, 379.01–379.09

[56] References Cited

U.S. PATENT DOCUMENTS

| | | | |
|---|---|---|---|
| 4,423,862 | 1/1984 | Hewitt | 73/379.08 |
| 5,125,270 | 6/1992 | Kovacevic | 73/379.02 |
| 5,341,680 | 8/1994 | Smart et al. | 73/379.06 |
| 5,463,884 | 11/1995 | Woo et al. | 70/16 |
| 5,577,981 | 11/1996 | Jarvik | 73/379.01 |

*Primary Examiner*—Robert Raevis

[57] ABSTRACT

A hand grip and arm strength testing apparatus is used as part of a pursuit and restraint circuit in a constable selection process. The apparatus which simulates the action required to move an uncooperative individual's arms to a handcuffing position comprises a support structure with a pair of moveable arms each of which is biased to a widespread position relative to the other arm. Each of the arms has a handle with a lock which is biased to a locking position and which locks against movement of the arm on which the handle is provided. The lock is moveable to an unlocking position by hand grip pressure sufficient to overcome the bias on the handle lock whereby the arm is then swingable inwardly from its widespread position when sufficient arm strength is applied to, and overcomes, the bias on the arm.

10 Claims, 4 Drawing Sheets

FIG. 2.
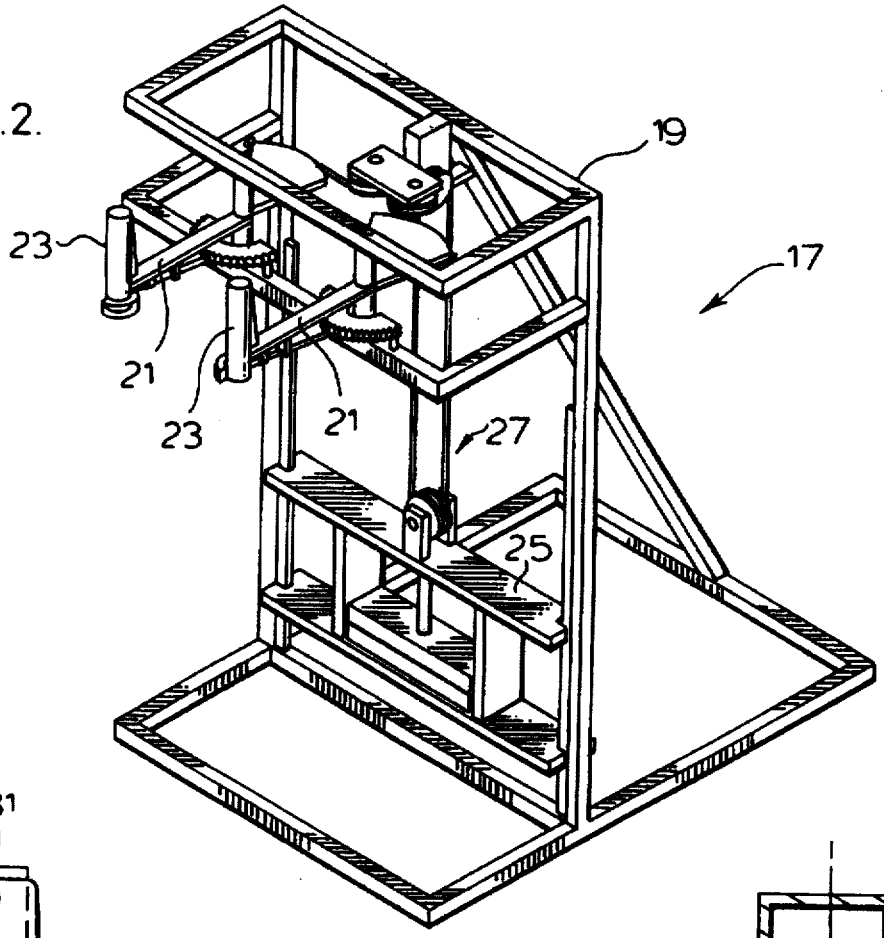
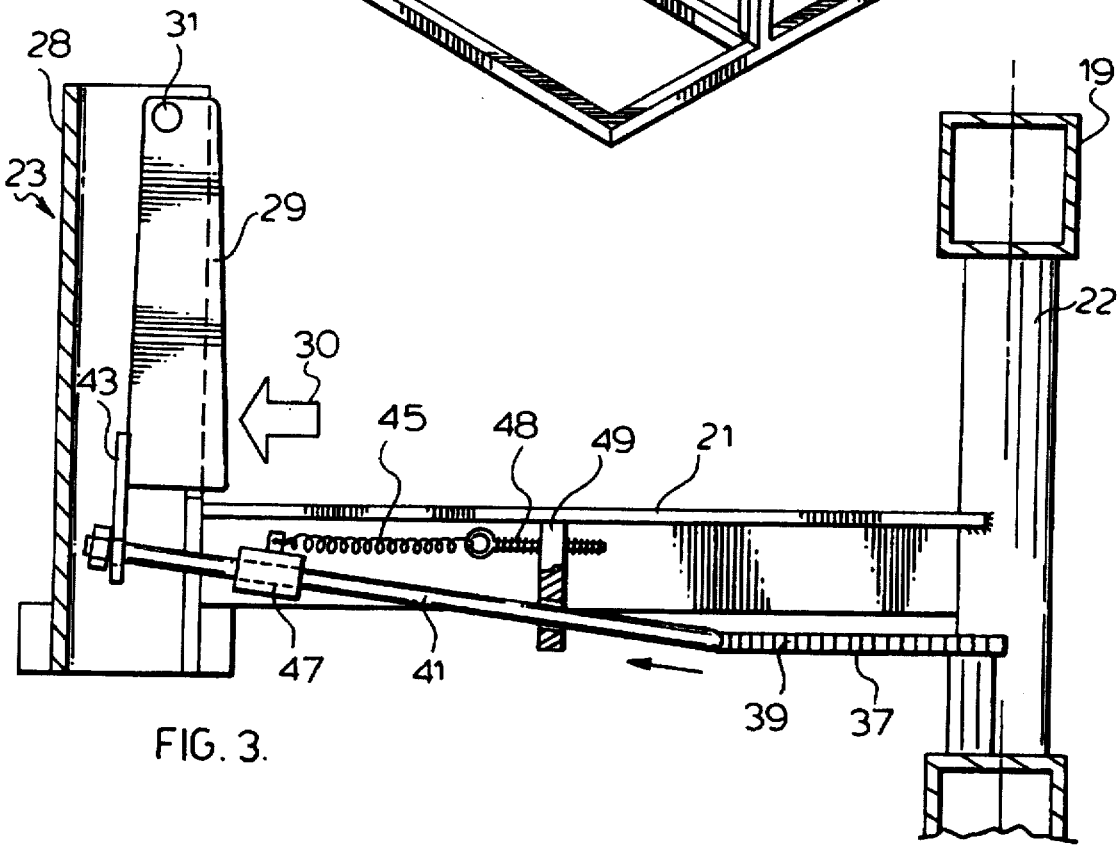
FIG. 3.

HAND AND ARM STRENGTH TESTING APPARATUS TO BE USED IN A CONSTABLE SELECTION PROCESS

FIELD OF THE INVENTION

The present invention relates to a hand grip and arm strength testing apparatus which stimulates a handcuffing motion used in a pursuit and restraint circuit of a constable selection process.

BACKGROUND OF THE INVENTION

In order for an individual to be selected as a constable in a police force that individual must demonstrate the physical attributes required to perform certain tasks required in the line of duty. Accordingly, the candidates for the constable position must pass certain tests including a required performance in a pursuit and restraint testing circuit.

Such testing circuits have been used by different police forces in the past. These circuits may vary from one police force to another. However, they are all consistent from the standpoint that they have some cardiovascular performance requirements and some strength testing requirements.

A situation which occurs on a relatively regular basis to constables in the field is resistance to arrest where the person being arrested will resist putting his or her hands in a handcuffing position.

A handcuff position simulator has been part of the prior art pursuit and restraint circuits. This simulator only tested for arm strength and did not require any hand grip strength for its operation. However, hand grip strength is a requirement for holding an individual's arms while they are being moved by arm strength to the handcuffing position.

SUMMARY OF THE PRESENT INVENTION

The present invention relates to a hand grip and arm strength testing apparatus which can be used as a handcuff positioning simulator in a pursuit and restraint circuit. The apparatus itself comprises a support structure with a pair of moveable arms each of which is biased to a widespread position relative to the other arm. Each of the arms has a handle with locking means which is biased to a locking position and which locks against movement of the arm on which the handle is provided when in the locking position. The locking means is moveable to an unlocking position by hand grip pressure sufficient to overcome the bias on the locking means. Each arm is swingable inwardly from its widespread position only when the locking means is in the unlocking position and when sufficient arm strength is applied to, and overcomes, the bias on the arm.

BRIEF DESCRIPTION OF THE DRAWINGS

The above as well as other advantages and features of the present invention will be described in greater detail according to the preferred embodiments of the present invention in which:

FIG. 2 is a perspective view of a hand grip and arm strength testing apparatus forming part of the circuit of FIG. 1.

FIG. 3 is a sectional view of the upper end of the apparatus of FIG. 2.

DETAILED DESCRIPTION ACCORDING TO THE PREFERRED EMBODIMENTS OF THE PRESENT INVENTION

Figure 1:
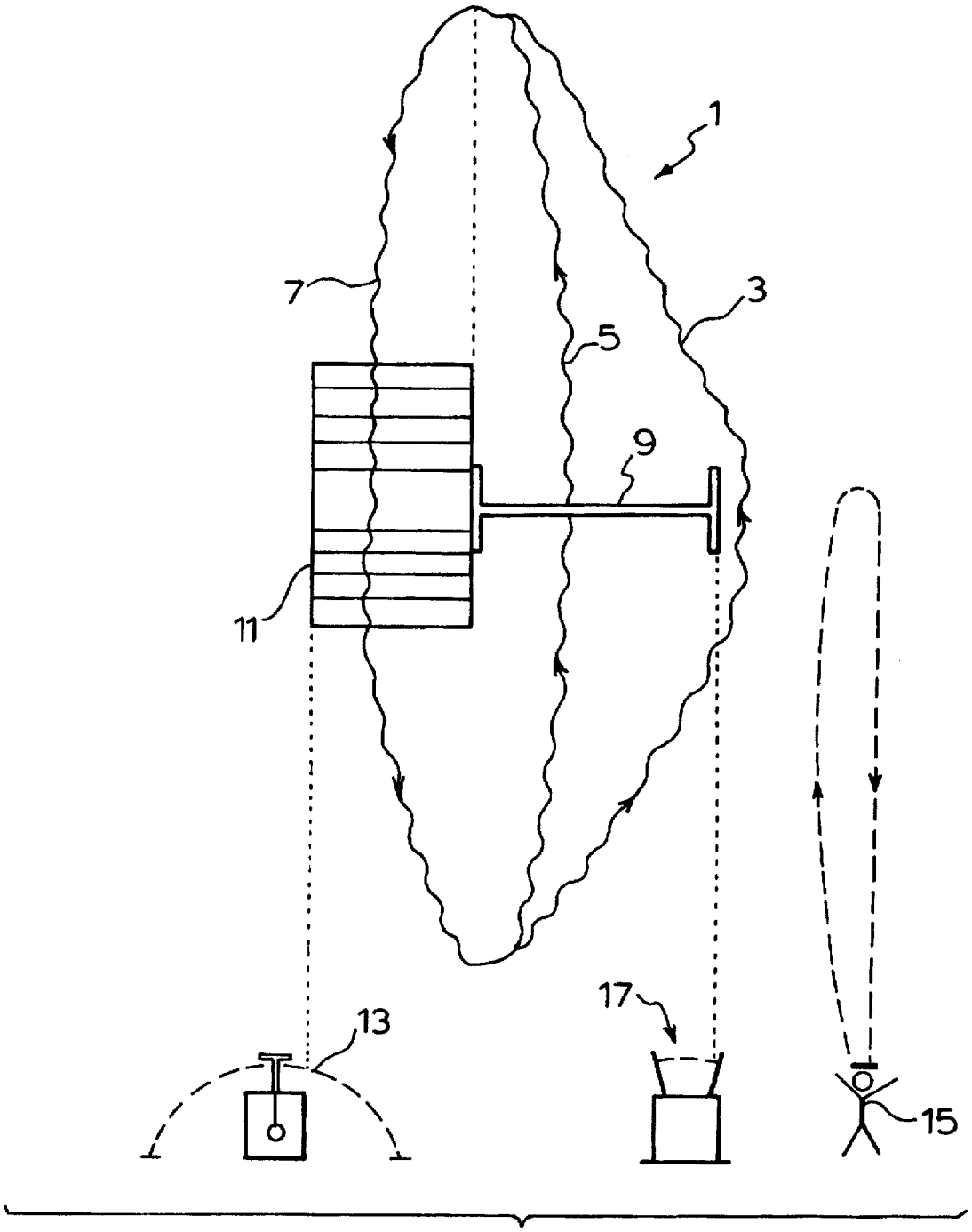
FIG. 1 is a schematic view of a pursuit and restraint circuit in accordance with a preferred embodiment of the present invention.

FIG. 1 shows a pursuit and restraint circuit generally indicated at 1 used in a constable selection program according to a preferred embodiment of the present invention. The circuit must be completed in a specified time in order to receive a passing grade.

A number of stations are used in forming the circuit. These stations include a running track having different legs 3, 5 and 7. According to one testing program, the candidates must complete four rotations of the track which comprises the pursuit part of the circuit. In the first and third trips around the track the individual must start from Point A moving along leg 3 to Point B and then back along leg 7 returning to Point A. A series of stairs 11 are provided along leg 7 and these stairs must be climbed and descended in all passes along leg 7.

In the second and fourth turns around the track, the candidate must proceed from Point A along leg 5 to Point B once again returning to Point A along leg 7. A four foot fence 9 must be cleared in order to complete leg 5 of the circuit.

After completing the pursuit part of the circuit, the candidate moves to a body control simulator 13. This simulator has both push and pull features which must be properly controlled and carried out while moving the simulator in a specified manner in order to properly complete this part of the circuit. From here the individual moves to an arm restraining device 17 which will be described later in detail.

In order to complete the circuit the candidate must move a human body simulator 15 in what is referred to as a victim relocation test. Body simulator 15 must be handled with the same care as one would handle a living person.

As noted above, an arm restraint device 17 forms part of the overall circuit 1. This arm restraint device is best seen having reference to FIGS. 2 through 5 of the drawings.

The arm restraint device requires both grip and arm strength and is used to simulate the actions required in overcoming an uncooperative individual resisting his or her arms and hands being moved to a handcuffing position.

Device 17 comprises a support structure 19 which is either heavy enough on its own to resist movement or in the alternative may be secured to the floor on which it is seated. A pair of arms 21 project outwardly to one side of the machine. In the embodiment shown, these arms lie in the same plane and are swingable between a widespread position WS and a narrow set position NS shown respectively in dotted and solid lines in FIG. 5 of the drawings. The widespread position typifies the arm position of an uncooperative individual while the narrow set position is the position required for handcuffing purposes.

As mentioned above arms 21 are swingable on the support structure 19. Each of the arms swings around its mounting post 22 which is rotatably secured to the support structure 19.

Provided at the outer end of each arm 21 is a handle 23. This handle 23 comprises a fixed portion 28 and a moveable portion 29. The moveable portion is pivotally secured at its upper end 31 to the fixed portion 28 of the handle 23 as best seen in FIG. 3 of the drawings.

As also seen in FIG. 3 of the drawings, the moveable portion 29 which is in the form of an elongated lever normally projects, particularly at its lower end, outwardly from the fixed portion 28 of the handle. This occurs through the bias provided on the lever 29 by a spring loaded rod 41 having an inner end plate 43 against the interior surface of the lever 29. Rod 41 is provided with a fixed collar 47 attached through a spring 45 to a plate 49 attached to the arm 21. Rod 41 is fitted through an opening in plate 49 as can well be seen in both figures 3 and 4 of the drawings.

Spring 45 is attached to plate 49 by a screw 48 which can be threaded in or out relative to the plate to adjust the tension on the spring.

Lever 29 normally sits in the FIG. 3 position which is a locking position preventing any swinging of the arm to which it is mounted through the handle 23.

Figure 4:
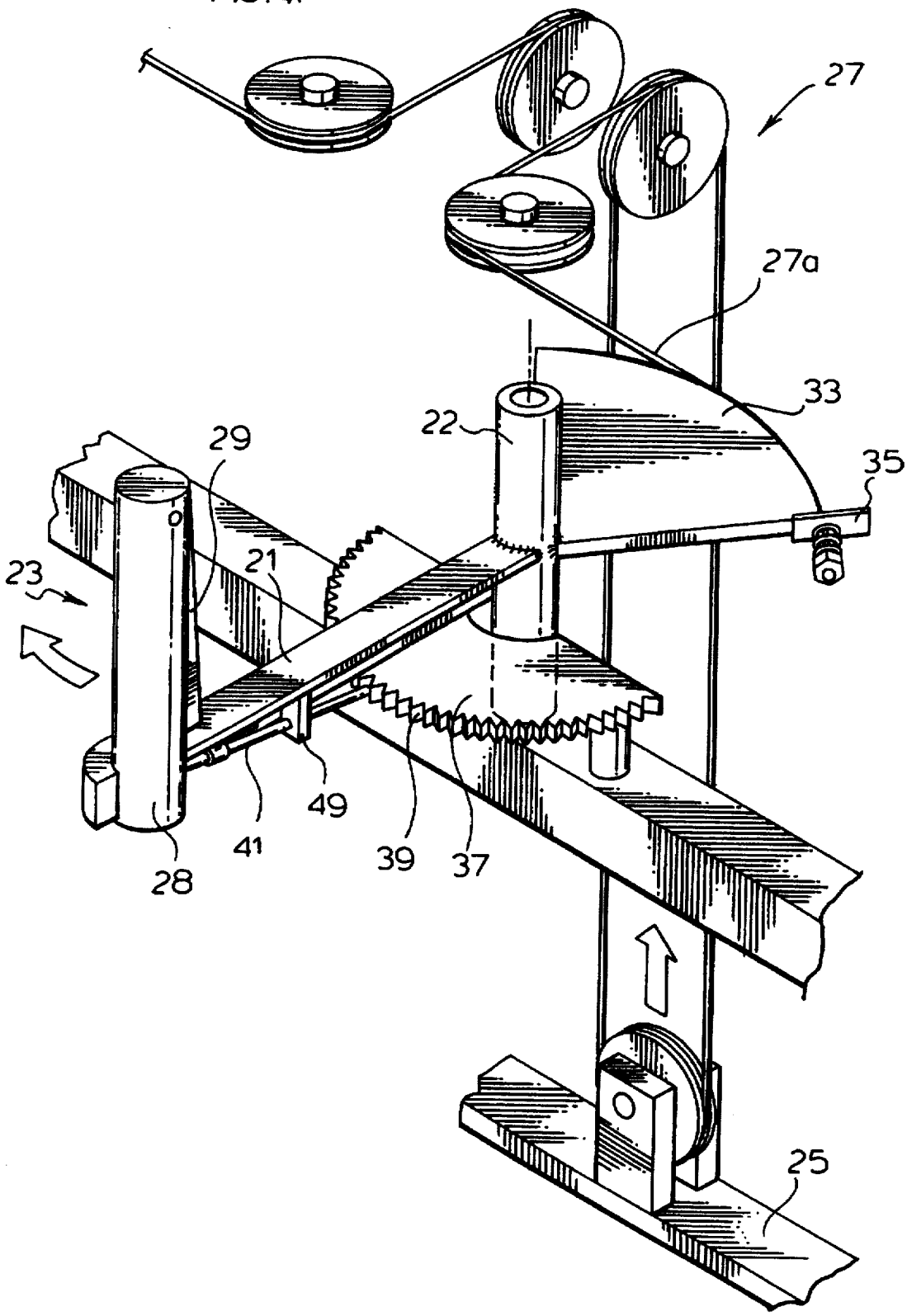
FIG. 4 is a perspective view of one of the arms of the apparatus of FIG. 2.

This locking position is better understood having reference to FIG. 4 of the drawings. Here will be seen that the mounting post 22 of the arm 21 sits directly behind a plate 37 having a notched outer surface 39. Rod 41 which as described above is slideable through plate 49 sits in any one of the notches on the outer curved surface of plate 37. When lever 29 is in a locking position the rod therefore prevents any swinging movement of the arm when engaged with the notched surface 39 of plate 37.

Lever 29 can however be used to pull the rod 41 away from plate 37. This is accomplished by the candidate placing his or her hand on the fixed portion 28 of the handle 23 and squeezing the lever 29 inwardly in the direction of arrow 30 with sufficient grip strength to overcome the bias of spring 45. The rod 41 is then pulled by its rear plate 43 away from notched surface 39 of plate 37 to enable swinging movement of the arm.

It is to be understood that if the candidate is unable to maintain sufficient grip strength on the lever 29 at any time during the arm swinging movement rod 41 will move back into engagement with the notched surface 39 making any further movement of the arm 21 impossible. This provides two features; firstly, it shows that the candidate does not have sufficient prolonged grip strength and secondly, it provides a safety feature as described immediately below in detail.

Figure 5:
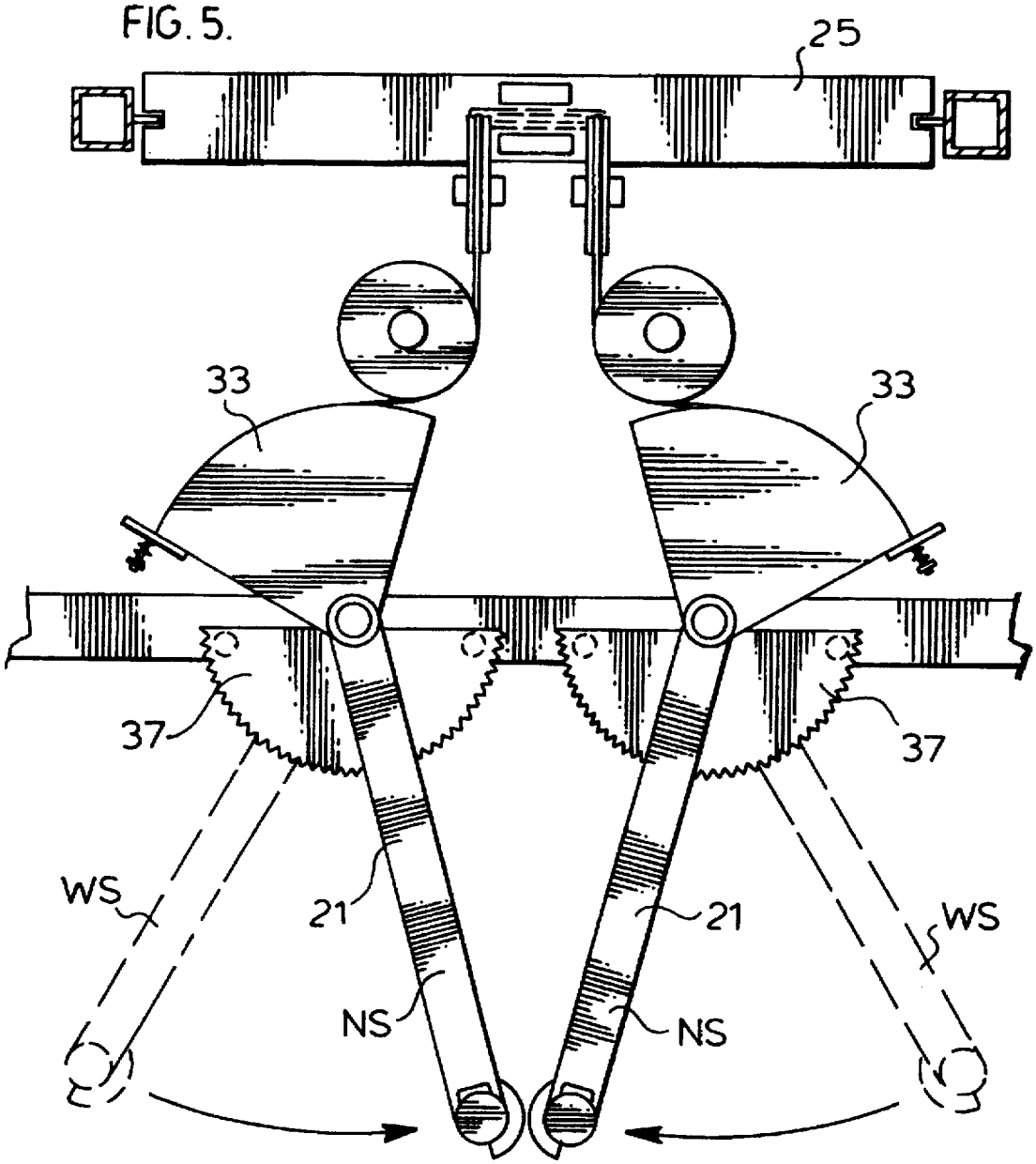
FIG. 5 is a top view of the arms of the apparatus of FIG. 1 showing movement of the arms from a widespread to a narrow set position.

Each of the arms 21 without the locking feature would swing out to the widespread position WS of FIG. 5. They are biased to this position by a weight 25 slideable vertically of the support structure 25. This weight is connected through a cable and pulley arrangement generally indicated at 27 in FIG. 4 to a plate 33 secured to the mounting post 22 of the arm 21. Specifically, the cable end 27 is secured by an attachment member 35 to the outside edge of plate 33. With this setup,weight 25 wants to pull the cable 27(*a*) and the plate 33 inwardly towards the center of the structure. The arm 21, which is on the opposite side of the mounting post 22 from the plate 23, therefore, wants to swing outwardly to its widespread position. This however will not occur if the candidate releases lever 29 whereby rod 41 returns to the locking position locking the arm against swinging outwardly. As will be appreciated, the amount of weight or bias on the arms to the widespread position can be varied simply by increasing or decreasing the weight 25.

In order for the candidate to properly pass the arm restraint portion of the circuit, he or she must be able to apply sufficient arm strength to the arms 21 to swing them inwardly to the narrow set position NS overcoming the bias of weight 25. Again this can only be achieved when rod 41 has been moved and continuously held by sufficient grip pressure on the handle to the unlocking position. Also, the arms 21 with their respective locking handles must be controlled individually to swing them both to the narrow set position.

It will now be seen that both grip and arm strength are simultaneously required in order to operate the arm restraint device 17 simulating the control and strength requirements of a constable in the field.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A hand grip and arm strength testing apparatus comprising a support structure with a pair of moveable arms each of which is biased to a widespread position relative to the other arm, each of said arms having a handle with locking means which is biased to a locking position and which locks against movement of the arm on which the handle is provided, said locking means being moveable to an unlocking position by hand grip pressure sufficient to overcome the bias on said locking means, and each arm being swingable inwardly from its widespread position only when said locking means is in the unlocking position and when sufficient arm strength is applied to, and overcomes, the bias on the arm.

2. A hand grip and arm strength testing apparatus as claimed in claim 1 wherein each arm is locked against swinging as soon as the locking means of the handle on the arm is allowed to move to the locking position.

3. Apparatus as claimed in claim 1 wherein each arm is biased toward the widespread position by weight means.

4. Apparatus as claimed in claim 3 wherein said arms are both attached to said weight means by a cable and pulley arrangement, said arms being swingable in a horizontal plane towards one another to lift said weight means when the locking means on said handles are in the unlocking position.

5. Apparatus as claimed in claim 3 wherein said weight means is adjustable in weight to vary resistance to inward swinging of said arms.

6. Apparatus as claimed in claim 1 wherein each of said handles comprises a fixed portion and a moveable portion pivotally secured at one end to the fixed position, the moveable portion comprising a lever biased by spring pressure to project outwardly to one side of the fixed portion and being pullable inwardly relative to the fixed portion by grip strength sufficient to overcome the spring pressure.

7. Apparatus as claimed in claim 6 wherein each arm is pivotally secured to said support structure and pivots relative to a notched member having a series of notches therein on said support structure, each moveable portion on each handle controlling a rod which is driven into any one of the notches when said handle is in the locked position providing the locking of the arm and which is pulled away from the notches when the moveable portion of the handle is pulled to the unlocking position enabling movement of the arm when sufficient arm strength is applied to the arm.

8. Apparatus as claimed in claim 6 wherein the spring pressure is adjustable to vary resistance to inward pulling of the lever to the unlocking position.

9. Apparatus for simulating arm movement of an uncooperative individual to a handcuffing position, said apparatus comprising a support structure having a pair of arms swingable between a widespread and a narrow set position, biasing means biasing said arms to the widespread position, handles on said arms, locking members which are biased to a locking position where said arms are locked against movement, hand grip pressure operated members on said handles which, when pulled with sufficient hand grip strength, move said locking members to an unlocking position enabling inward swinging of said arms to the narrow set position when sufficient arm strength is used to overcome said biasing means biasing said arms toward the widespread position.

10. A testing circuit to test pursuit and restraint abilities of individuals in a constable selection process, said testing circuit comprising a track with height clearing obstacles on said track, a push and pull strength testing device, a human body simulating member to be moved in a specified manner within said testing circuit and a hand cuff positioning simulator which has a pair of arms swingably mounted to a support structure, said arms being biased to swing outwardly away from one another, handles on said arms, lock members which lock against movement of said arms, lock controlling members on said handles, said lock controlling members being moveable by grip strength to pull said lock members to an unlocking position which enables inward swinging of said arms when sufficient arm strength is applied to said arms to overcome the bias on said arms.

* * * * *